US012704362B1

(12) United States Patent
Kraft

(10) Patent No.: US 12,704,362 B1
(45) Date of Patent: Aug. 11, 2026

(54) CUSTOMIZABLE PROJECTILE DESIGNED TO TUMBLE

(71) Applicant: Rekon, LLC, Pittsburg, KS (US)

(72) Inventor: Ryan E. Kraft, Fort Scott, KS (US)

(73) Assignee: Rekon, LLC, Pittsburg, KS (US)

( * ) Notice: Subject to any disclaimer, the term of this patent is extended or adjusted under 35 U.S.C. 154(b) by 0 days.

(21) Appl. No.: 19/239,618

(22) Filed: Jun. 16, 2025

Related U.S. Application Data

(62) Division of application No. 18/239,623, filed on Aug. 29, 2023, now Pat. No. 12,332,035.

(60) Provisional application No. 63/373,824, filed on Aug. 29, 2022.

(51) Int. Cl.
*F42B 30/02* (2006.01)
*F42B 12/02* (2006.01)
*F42B 30/08* (2006.01)

(52) U.S. Cl.
CPC ..... *F42B 30/02* (2013.01); *F42B 12/02* (2013.01); *F42B 30/08* (2013.01)

(58) Field of Classification Search
CPC .... F42B 5/02; F42B 5/025; F42B 8/12; F42B 8/14; F42B 12/00; F42B 12/02; F42B 30/02; F42B 30/08
USPC ..... 102/501
See application file for complete search history.

(56) References Cited

U.S. PATENT DOCUMENTS 34,493 A 2/1862 Havens
2,368,587 A * 1/1945 Wise ..... F41H 11/04 102/504
3,545,383 A 12/1970 Lucy
4,016,817 A 4/1977 Arciniega Blanco
4,301,733 A 11/1981 Arciniega Blanco
5,038,684 A * 8/1991 Petrovich ..... F42B 12/78 102/515
5,164,538 A 11/1992 McClain, III
6,305,293 B1 10/2001 Fry et al.
6,349,651 B1 2/2002 Martinez Garcia
6,502,516 B1 1/2003 Kinchin
7,331,294 B2 2/2008 Mank
7,735,422 B2 6/2010 Riess et al.
8,117,967 B2 * 2/2012 Salvel ..... F42B 30/02 102/517
8,267,015 B2 9/2012 Marx
(Continued)

FOREIGN PATENT DOCUMENTS

CH 700584 B1 * 9/2010 ..... F42B 5/025
DE 4022821 C2 * 7/1993 ..... F42B 12/06

*Primary Examiner* — James S Bergin
(74) *Attorney, Agent, or Firm* — AVEK IP, LLC

(57) ABSTRACT

A projectile may include a first portion having a first cylindrical portion with a first flat end surface, a section extending from the first cylindrical portion at an acute angle, and a tip section extending from the section and terminating in a tip. The projectile may include a second portion having a second cylindrical portion having a second flat end surface. The projectile may include a trailing portion with generally frustoconical shape, the trailing portion tapering towards a trailing end. The projectile may include a post contacting each of the first flat end surface and the second flat end surface, the post being cylindrical and having a post diameter that is less than each of a diameter of the first cylindrical portion and the second cylindrical portion. The projectile is configured to tumble and break upon impact with a target.

20 Claims, 12 Drawing Sheets

(56) References Cited

U.S. PATENT DOCUMENTS

| | | | | |
|---|---|---|---|---|
| 9,541,362 | B2 | 1/2017 | Kraft et al. | |
| 9,746,296 | B2 | 8/2017 | Kraft et al. | |
| 12,332,035 | B1 | 6/2025 | Kraft | |
| 2015/0090147 | A1* | 4/2015 | Burke | F42B 12/367 102/517 |

* cited by examiner

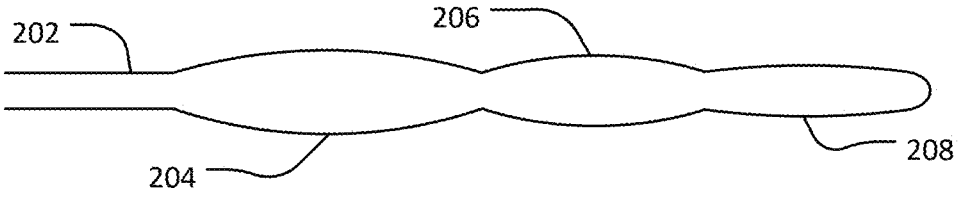
FIG. 5 – PRIOR ART
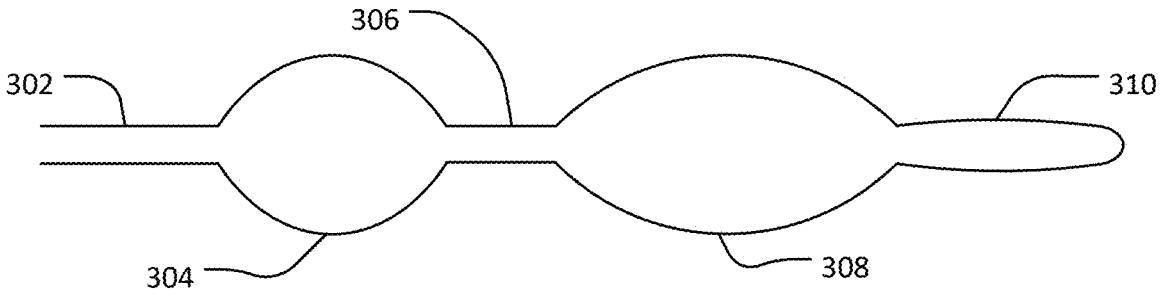
FIG. 6
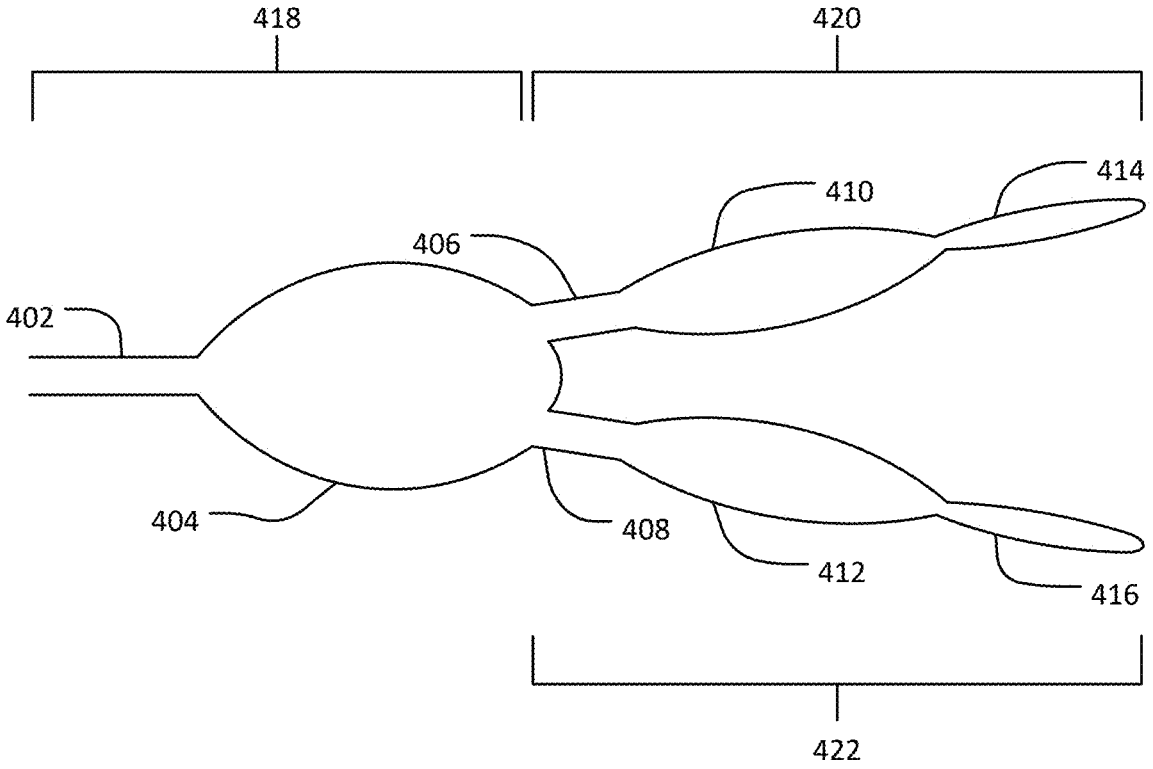
FIG. 7

CUSTOMIZABLE PROJECTILE DESIGNED TO TUMBLE

CROSS REFERENCE TO RELATED APPLICATIONS

This application is a divisional of U.S. patent application Ser. No. 18/239,623, filed Aug. 29, 2023, which claims priority to U.S. Provisional Patent Application No. 63/373,824, filed Aug. 29, 2022, the disclosure of each of which is incorporated by reference in their entirety herein.

FIELD OF INVENTION

The field of the invention is projectiles for use in cartridges fired from handguns and other firearms.

BRIEF SUMMARY OF INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In some aspects, the techniques described herein relate to a projectile, the projectile includes a first portion having a first cylindrical portion having a first flat end surface, a section extending from said first cylindrical portion at a first acute angle, and a tip section extending from said section and terminating in a tip. The projectile includes a second portion having a second cylindrical portion having a second flat end surface. The projectile includes a trailing portion having a generally frustoconical shape, said trailing portion tapering towards a trailing end of said projectile. The projectile includes a post coupling said first cylindrical portion and said second cylindrical portion, said post being in contact with each of said first flat end surface and said second flat end surface, said post being cylindrical and having a post diameter that is less than each of a diameter of said first cylindrical portion and a diameter of said second cylindrical portion. The projectile is configured to tumble upon impact with a target, and said post is configured to break upon impact with said target.

In some aspects, the techniques described herein relate to a projectile, wherein said first cylindrical portion includes a groove.

In some aspects, the techniques described herein relate to a projectile, wherein said second cylindrical portion includes a groove.

In some aspects, the techniques described herein relate to a projectile, wherein a length of said section is proportional to a tumbling characteristic of said projectile, such that increasing said length of said section increases the tumbling characteristic of said projectile.

In some aspects, the techniques described herein relate to a projectile, wherein said projectile is configured to create a plurality of channels in said target after impact with said target.

In some aspects, the techniques described herein relate to a projectile, further including a cartridge.

In some aspects, the techniques described herein relate to a projectile, wherein said tip section extends from said section at a second acute angle.

In some aspects, the techniques described herein relate to a projectile, wherein said second acute angle is sharper than said first acute angle.

In some aspects, the techniques described herein relate to a projectile, the projectile includes a first portion having a first flat end surface. The projectile includes a second portion having a second flat end surface; and a post coupling said first portion and said second portion at said first flat end surface and said second flat end surface such that at least a portion of each of said first flat end surface and said second flat end surface is exposed. The projectile is configured to tumble upon impact with a target, and said post is configured to break upon impact with said target.

In some aspects, the techniques described herein relate to a projectile, wherein said first portion includes a first section adjacent said post, said first section tapering at a first angle. A second section is adjacent said first section, said second section tapering at a second angle.

In some aspects, the techniques described herein relate to a projectile, further including a tip section with a tip having a diameter, wherein said diameter is inversely proportional to a tumbling characteristic of said projectile, such that decreasing said diameter of said tip increase said tumbling characteristic of said projectile.

In some aspects, the techniques described herein relate to a projectile, further including a frustoconical trailing section having a trailing section flat end surface.

In some aspects, the techniques described herein relate to a projectile, wherein said projectile terminates at said trailing section flat end surface.

In some aspects, the techniques described herein relate to a projectile, wherein said post is cylindrical.

In some aspects, the techniques described herein relate to a projectile, wherein said second portion includes at least one groove.

In some aspects, the techniques described herein relate to a projectile, wherein said first portion includes at least one groove.

In some aspects, the techniques described herein relate to a projectile, the projectile includes a first portion having a first cylindrical portion having a first flat end surface, a section extending from said first cylindrical portion, and a tip section extending from said section and terminating in a tip. The projectile includes a second portion having a second cylindrical portion having a second flat end surface. The projectile includes a post coupling said first cylindrical portion and said second cylindrical portion, said post being in contact with each of said first flat end surface and said second flat end surface, said post being cylindrical and having a post diameter that is less than each of a diameter of said first cylindrical portion and a diameter of said second cylindrical portion. The projectile is configured to tumble upon impact with a target, and said post is configured to break upon impact with said target.

In some aspects, the techniques described herein relate to a projectile, wherein said projectile is configured to create a plurality of channels in said target after impact with said target.

In some aspects, the techniques described herein relate to a projectile, further including at least one groove in each of said first portion and said second portion.

In some aspects, the techniques described herein relate to a projectile, wherein said projectile terminates in a trailing section having a flat end.

BRIEF DESCRIPTION OF DRAWINGS

FIG. 5 is a schematic showing the motion of a projectile, according to a prior art design, fired into ballistic gel.

FIG. 6 is a schematic showing the motion of the projectile of FIG. 1, fired into ballistic gel.

FIG. 7 is a schematic showing the motion of the projectile of FIG. 3, fired into ballistic gel.

DETAILED DESCRIPTION OF THE INVENTION

Figure 1:
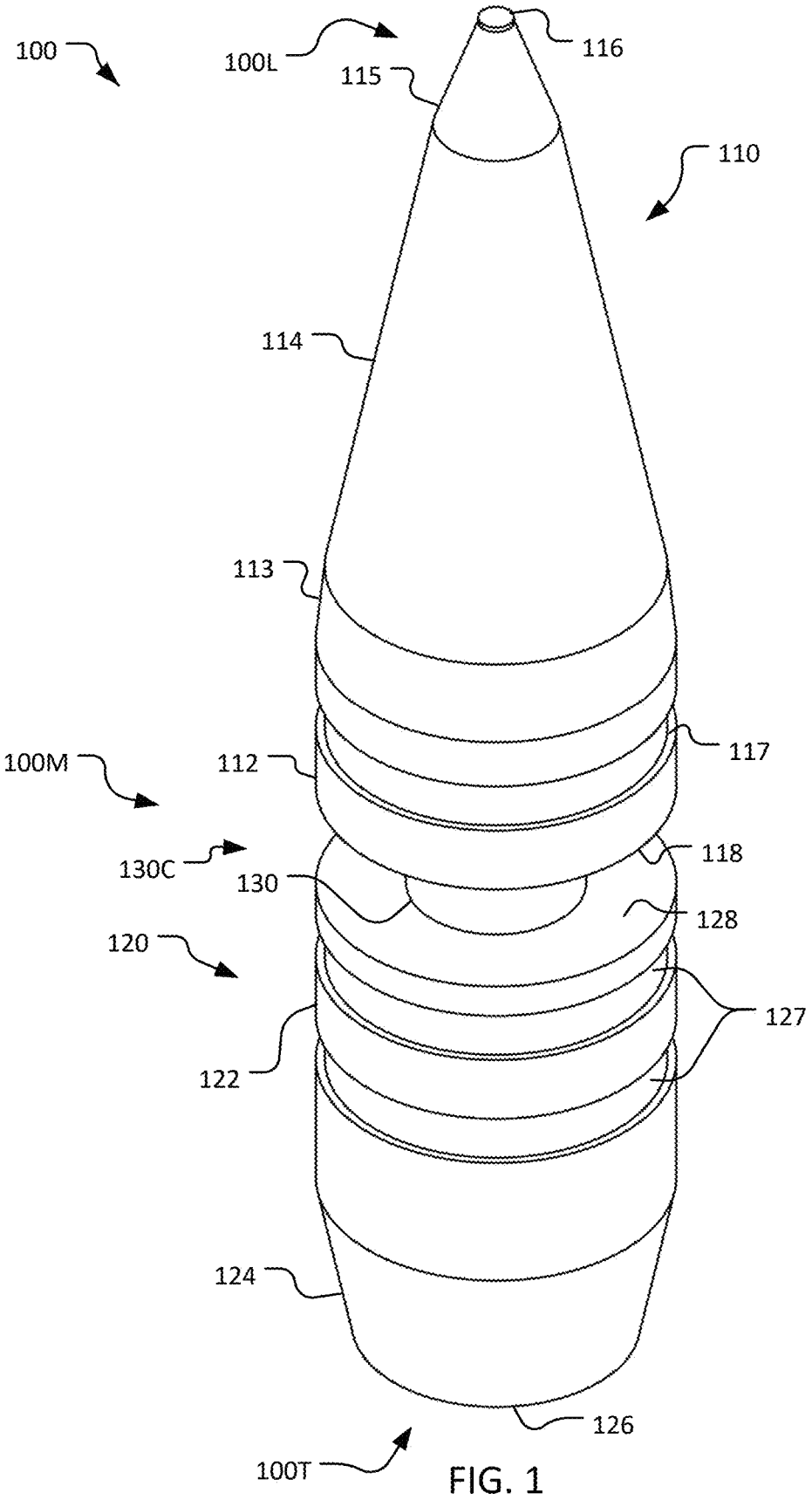
FIG. 1 is a perspective view of a projectile used in a firearm, according to an embodiment of the disclosure.

Projectiles, or bullets, are made in a variety of shapes and sizes depending upon their intended use. The shape and size of a projectile affects the kinetic energy that is transferred to a target upon impact (sometimes referred to as "terminal ballistics"), as well as how the projectile travels through the air (sometimes referred to as "external ballistics"). The kinetic energy of a discharged projectile will be a function of its mass and its velocity via the well-known formula: Kinetic Energy (KE)=½ (mass)(velocity)(velocity). Often, as is the case in hunting, it is desirable to maximize the kinetic energy transferred by the projectile, thus increasing the lethality of the projectile. It is also desirable to increase the likelihood of striking a vital organ or other important area with the projectile.

Most projectiles that are designed to optimize, or otherwise increase, lethality suffer from various shortcomings. Expanding, fragmenting, and frangible projectiles, for example, succeed in causing an increased amount of damage to a target, compared to the average projectile. However, these projectiles frequently transfer an inadequate amount of energy to the target. Further, expanding, fragmenting, and frangible projectiles are generally difficult to control in-flight and/or while traveling through a medium besides air (e.g., solids, viscous materials, animal flesh, et cetera).

Expanding projectiles, such as hollow point rounds, tend to create temporary wound channels or cavitations from the shockwave of the expanding projectile slamming through a target. This may be desirable in some applications yet fall short in others. For instance, while the shockwave generated by hollow point rounds may transfer more energy to a target than a normal round, certain types of targets or target materials are more resilient to the damage caused by such rounds. Flexible targets, such as animal organs or tissue, tend to absorb these temporary shockwaves relatively well in some cases. In certain applications, such as hunting applications, such a result is considered undesirable, or even less ethical, as it merely leaves a target alive and wounded. In still some conventional cases, the projectile may pass straight through a target, creating a relatively small wound channel while imparting very little energy to the target. These small wound channels are much less likely to hit a vital area. Rounds or projectiles that create more, larger, and/or more permanent wound channels are needed to inflict lethal damage more reliably to these targets.

Fragmenting and frangible projectiles tend to transfer more energy to the target relative to standard projectiles. Such a benefit of these fragmenting/frangible projectiles does not come without its own cost. These projectiles are often found to break up into too many pieces to effectively deliver damage to the target. The pieces may be too small to penetrate far enough into the target, or the pieces may be too small to strike a vital area. In effect, these fragmenting/frangible projectiles often arrive at a result that runs counter to their very purpose of delivering energy to a target in an effective, humane manner.

Projectiles that are designed to tumble after striking a target typically transfer a high amount of kinetic energy. A problem observed with prior art designs for tumbling projectiles is the inability to control how and when the projectile tumbles. Embodiments of a customizable projectile designed to tumble disclosed herein may solve the above discussed issues at least in part. At least some of these projectile embodiments may segment after impacting a target. The word segment, as used herein, has a distinct meaning from fragment. Herein, segment may mean to break or otherwise separate into a limited, controlled number of pieces. For instance, as will be discussed in greater detail below, projectile embodiments herein may segment into no more significantly sized pieces than the number of posts (e.g., posts 130') (FIGS. 3 and 4) a projectile embodiment has plus one. In the case of the projectile 100', which has one post 130', segmenting may mean breaking into no more than two pieces (e.g., first segment 140' and second segment 150'). In projectile embodiments that contain two posts (e.g., projectile 600) (FIGS. 9 and 10), the projectile embodiments may instead segment into only three pieces (e.g., first segment 640, second segment 650, and third segment 660).

Figure 2:
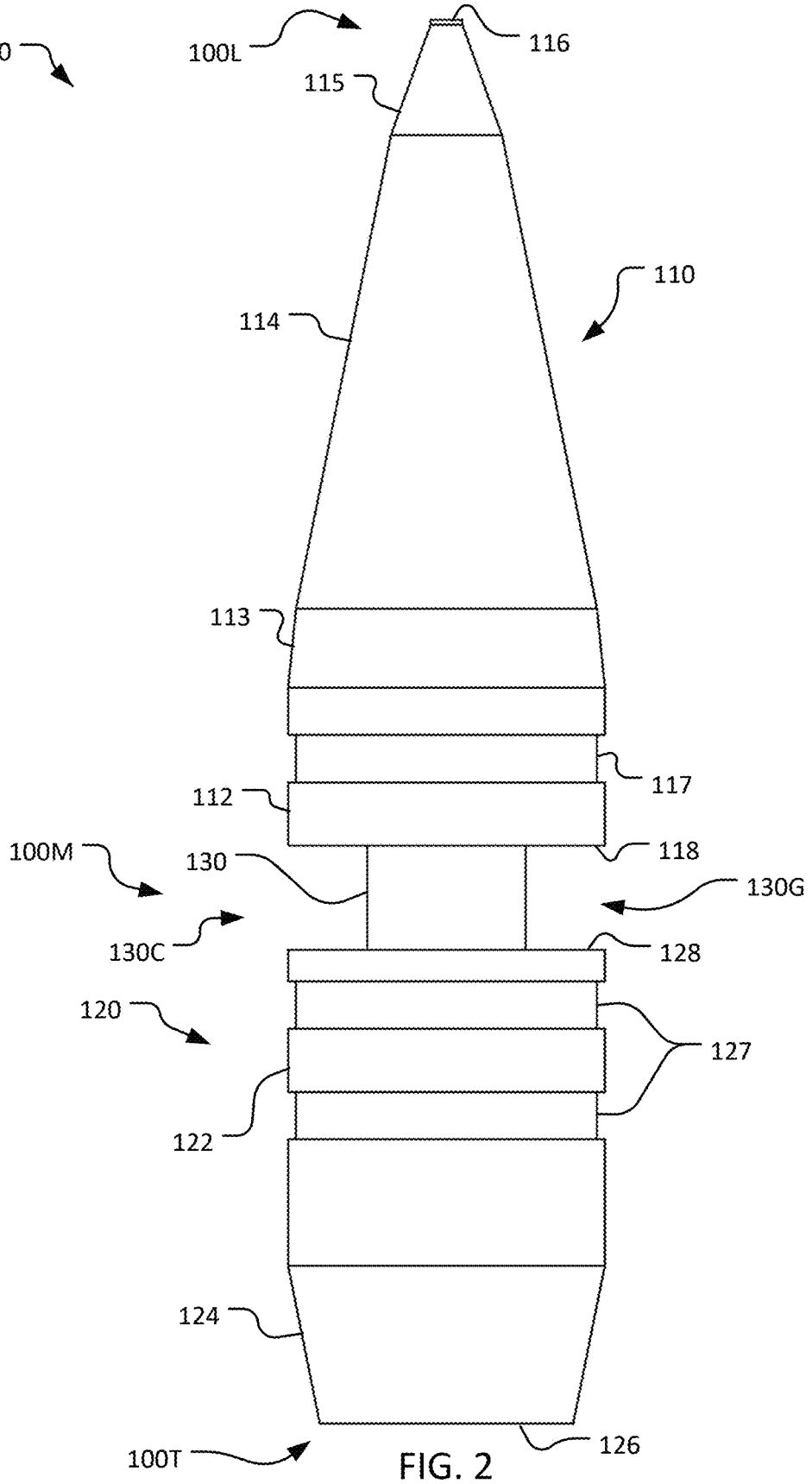
FIG. 2 is a side view of the projectile of FIG. 1.

Turning now to FIGS. 1 and 2, an embodiment 100 of a projectile is shown. The projectile 100 may have, very generally, a conical, spire, or spitzer style top portion 110 which is connected to a generally cylindrical bottom half 120 via a narrow segment or post 130. In operation, the post 130 may have dimensions such that the projectile 100 does not break apart upon tumbling within a target. Instead, the post 130 and components of the projectile 100 adjacent thereto may increase the overall energy dispersion/penetration characteristics of the projectile 100.

The projectile top portion 110 may have a generally cylindrical shaped portion 112 adjacent the post 130 with a first section 113 extending from the cylindrical portion 112 away from the post 130. A second section 114 may extend in turn from this first section 113 before turning into a section or tip 115 at a leading end 100L of the projectile 100. While the sections 112, 113, 114, and 115 may continuously lead one into the other, each of these sections may be differentiated by their individual tapering angle (or lack thereof). That is to say, the cylindrical portion 112 may be characterized by having little to no tapering angle (i.e., the walls of the portion 112 may extend generally straight up and down or perpendicular); the first section 113 may taper at a first angle as the section 113 extends towards the leading end 100L; the second section 114 may taper at a second angle as the section 114 extends towards the leading end 100L; and the tip 115 may taper at a third angle towards a point 116 at the leading end 100L. The top portion 110 may terminate opposite the leading end 100L in a surface 118 of the cylindrical portion 112. In embodiments, the surface 118 may be substantially flat where the cylindrical portion 112 meets the post 130. In still more embodiments, one or more of the section 113 and the section 114 may be foregone.

The artisan would understand that the tapering angles of the sections 112, 113, 114, and 115, may each, for example, be different from each other. In some embodiments, one or more of the sections 112, 113, 114, and 115 may have the same tapering angle as another section (e.g., an adjacent section, a non-adjacent section, et cetera). In still more embodiments, the tapering angles of sections 112, 113, 114, and 115 may increase as one approaches the leading end 100L (e.g., the cylindrical portion 112 may have no tapering angle, the first section 113 may have a tapering angle of about ten degrees, the second section 114 may have a tapering angle of about twenty degrees, the tip 115 may have a tapering angle of about 30 degrees, et cetera). In yet more embodiments, each of the tapering angles may be acute angles (e.g., acute angles that are each different from each other, acute angles that are the same as another, a combination thereof, et cetera). The artisan would understand that the tapering angles provided herein are associated with an embodiment, and that a variety of tapering angles and combinations thereof are contemplated herein and within the scope of the disclosure.

The first section 113 may generally have a smaller diameter than the cylindrical portion 112, although the first section 113 may vary in diameter and length. Likewise, the second section 114 may generally have a smaller diameter than the first section 113, and the tip 115 may generally have a smaller diameter than the second section 114. In some embodiments, the general shape of the top portion 110 may resemble a spitzer style projectile. In an embodiment, a length of the cylindrical portion 112 may be less than a length of the first section 113, which may be less than a length of the second section 114.

In embodiments, the cylindrical portion 112 may have one or more grooves or recesses 117 located across the length of the portion 112. These grooves 117 may increase stability of the projectile 100 as is travels through the air, prior to reaching the target. In principle, the grooves 117 may increase air resistance of the projectile 100 in such a manner so as to preclude the projectile 100 from deviating from its intended flight path. This may be accomplished by increasing air resistance of the projectile 100 behind, in the direction of travel, the center of gravity of the projectile 100. As discussed below, a gap 130G (FIG. 2) may achieve a similar effect.

The bottom portion 120 may extend away from the top portion 110 in the direction of a trailing end 100T. The bottom portion 120 may be made up of a second generally cylindrical portion 122 which has a trailing portion 124 extending away therefrom. Like the cylindrical portion 112, the second cylindrical portion 122 may have little to no tapering angle. The trailing portion 124, however, may have a frustoconical shape that may taper towards the trailing end 100T. This may result in the trailing portion 124 having a generally smaller diameter than the cylindrical portion 122. The trailing portion 124 may terminate at the substantially flat end 126, which may mark the furthest point of the projectile 100 in the trailing end 100T direction.

The second cylindrical portion 122 may terminate in a second surface 128 opposing the trailing end 100T. Similar to the surface 118, the second surface 128 may provide a substantially flat plane in the areas where the bottom portion 120 does not meet the post 130. Like the cylindrical portion 112 and the groove(s) 117, the cylindrical portion 122 may have one or more grooves or recesses 127 inlaid therein to improve the external ballistic characteristics of the projectile 100. One groove 127 may be spaced apart from another groove 127, as shown in FIG. 2. While the second cylindrical portion 122 is depicted in FIGS. 1 and 2 as having the same general diameter as the cylindrical portion 112, this may not be the case in all embodiments (e.g., the second cylindrical portion 122 may have a larger or smaller diameter than the cylindrical portion 112).

The post 130 may join both the top portion 110 and the bottom portion 120 together by extending between the surfaces 118 and 128 at a middle portion 100M (e.g., a midway point) of the projectile 100. The post 130 may be narrower (i.e., have a smaller diameter) than both the top portion 110 and the bottom portion 120. Specifically, the post 130 may have a smaller diameter than both the cylindrical portion 112 and the second cylindrical portion 122 of the projectile 100. The post 130 and the surfaces 118 and 128 may work together to form a gap 130G (FIG. 2). The post 130 and the gap 130G may sometimes be collectively referred to herein as a collar 130C. While the post 130 is described to be at the middle portion 100M of the projectile 100, the artisan would understand that the middle portion 100M is merely the section of the projectile 100 that spans between the top portion 110 and the bottom portion 120. That is to say, in embodiments, the total length of the top portion 110 (e.g., the cylindrical portion 112, the first section 113, the second section 114, the tip 115, and the point 116 thereof) may not equal (e.g., may be greater than or less than) the total length of the bottom portion 120 (the second cylindrical section 122 and the trailing portion 124 thereof).

The length and tapering angle of each of the sections 112, 113, 114, and 115 may influence the performance of the projectile 100 as the projectile 100 travels through non-air mediums, such as animal flesh or ballistic gel. For instance, the tumbling of the projectile 100 may be changed by increasing the length of the second section 114. Increasing such length may increase a tumbling characteristic of the projectile 100 (e.g., may cause the projectile 100 to begin to tumble shortly after or at the point of impact). Decreasing such length may decrease a tumbling characteristic of the projectile 100 (e.g., may cause the projectile 100 to begin to tumble farther from the point of impact, i.e., after penetrating some distance into the target). Adjusting the length of one or more of the other sections 112, 113, 114, and/or 115 may have a similar effect. The tumbling of the projectile 100 may also be controlled by flattening the point 116 so that there is a flat surface at the leading end 100L of the projectile 100. Increasing the diameter of such flat surface may decrease a tumbling characteristic of the projectile 100 (e.g., may cause the projectile to tumble further from the point of impact), whereas decreasing the diameter of such flat surface (e.g., decreasing all the way up to a pointed tip) may increase a tumbling characteristic of the projectile (e.g., may cause the projectile 100 to begin to tumble shortly after or at the point of impact). In this way, the tumbling of the projectile 100 may be customized, and the amount of energy imparted to the target adjusted or increased. This objective may be achieved while still maintaining the external ballistic advantages a spitzer style projectile has over other types of conventional projectiles, such as rounded, hollow point, or flat projectiles.

In addition to the customized tumbling described above, the post 130 and the surfaces 118 and 128 may improve the efficacy of the projectile 100. The post 130, surface 118, and surface 128 may act as cutting surfaces that cleave through the target once the projectile 100 begins to tumble. That is to say, once the projectile 100 begins to turn side on (sometimes referred to as "keyholing") inside the target during a tumble, the target material may begin to strike the projectile 100 within the gap 130G. The post 130, and the surfaces 118 and 128, may then slice the material within the gap 130G as the projectile 100 continues to travel. This feature may improve the lethality of the projectile 100 by creating more permanent wound channels within the target relative to a conventional projectile.

Figure 3:
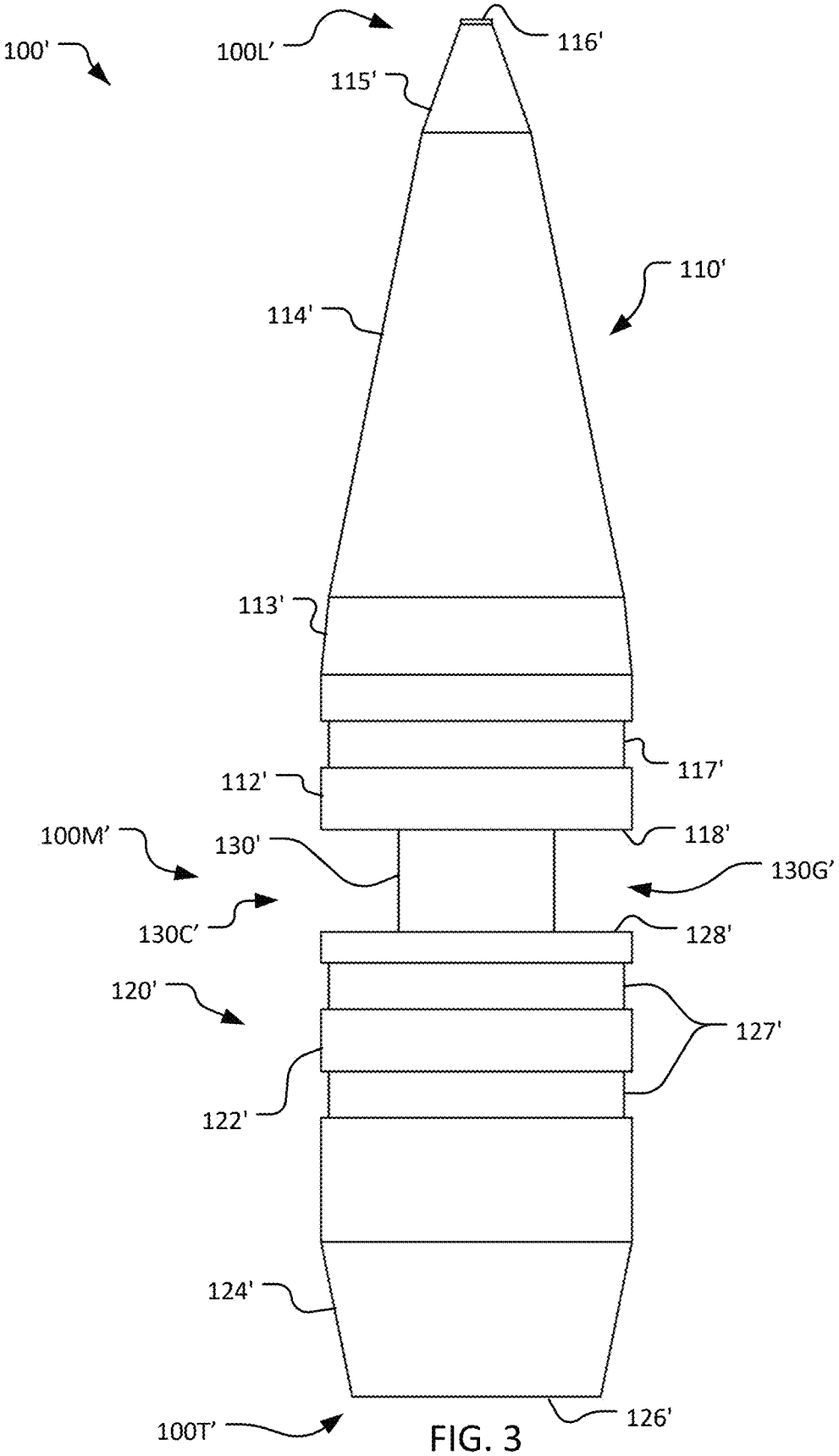
FIG. 3 is a side view of a projectile used in the firearm, according to another embodiment of the disclosure, before segmenting.
Figure 4:
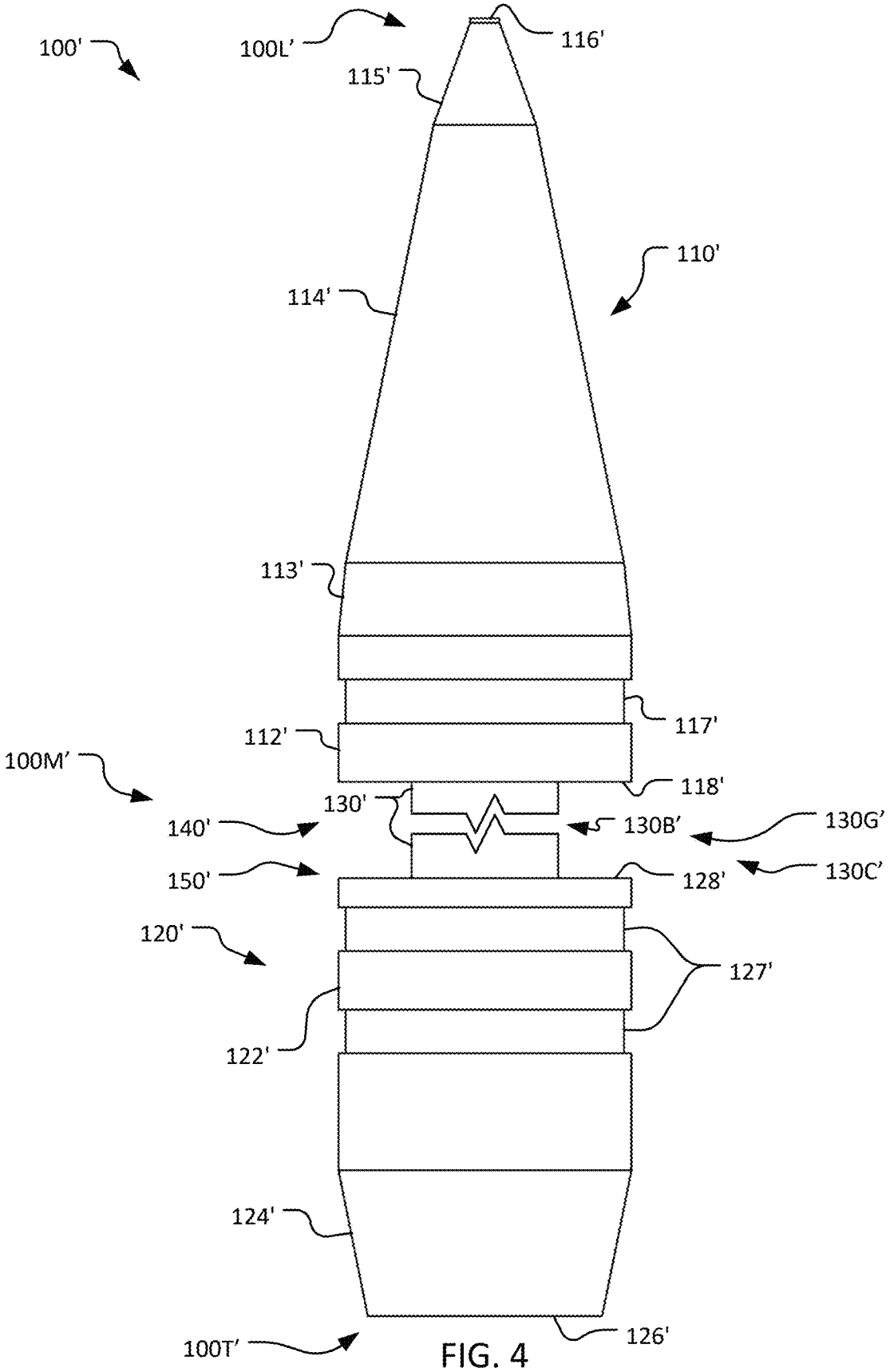
FIG. 4 is a side view of the projectile of FIG. 3, after segmenting.

FIGS. 3 and 4 shows an embodiment 100' of a projectile that may be substantially the same or similar to the embodiment 100, except where expressly noted or would be implied. The structure of the projectile 100' may be substantially the same as the projectile 100, except that the projectile 100' may be designed to break into two segments (e.g., first segment 140' and second segment 150') along the collar 130C' (e.g., the center post 130' thereof) after the projectile 100' penetrates a target and begins to tumble. The post 130' may desirably break when the post 130' is acted upon by a non-air medium which the projectile 100' is traveling through after the projectile 100' begins to tumble, keyhole, or otherwise turn sideways inside the target. FIG. 4 shows where an example break 130B' may occur (i.e., around the middle 100M' of the projectile 100'). The first segment 140' may largely comprise the top portion 110' and whatever portion of the post 130' remains attached to the top portion 110' after the break, and the second segment 150' may largely comprise the bottom portion 120' and whatever portion of the post 130' that remains attached to the bottom portion 120' after the break. Put another way, the first segment 140' may generally comprise the portion of the projectile 100' originally above the collar 130C', and the second segment 150' may generally comprise the portion of the projectile 100' originally below the collar 130C'. While some embodiments of the projectile 100' may have segments 140' and 150' of approximately the same size, this may not be the case in others.

For instance, the collar 130C' need not be arranged in such a manner as to result in segments 140' and 150' having roughly the same size (e.g., the segments 140', 150' may instead have disparate lengths, widths, heights, volume, density, and/or weight). This may mean that, in some embodiments, the collar 130C' is not located in the middle 100M' of the projectile 100'. Instead, the collar 130C' may be located anywhere else along the projectile 100', such as between any other desired components of the projectile 100'. For example, the collar 130C' may instead be located between the cylindrical shaped portion 112' and the first portion 113', between the first portion 113' and the second portion 114', between the second cylindrical section 122' and the trailing portion 124', et cetera. A collar 130C' that results in segments 140' and 150' of disparate sizes may still fracture upon tumbling within a target. Such a collar 130C' may grant the projectile 100' different penetration and/or energy dispersion characteristics than a projectile 100' whose collar 130C' lies in the middle portion 100M' (i.e., whose resulting segments 140', 150' would have roughly the same size). Specifically, one segment 140', 150' which is of a different size than the other segment 140', 150' may interact with a target in a correspondingly different manner. Details of these disparate interactions will be explored in greater detail below.

Returning now to FIGS. 3 and 4, the projectile 100' may break along the collar 130C' of the projectile 100' while tumbling, and the gap 130G' may temporarily increase in size before the segments 140' and 150' completely separate and independently travel through the target. This segmentation of the projectile 100' may increase the efficacy of the projectile 100' in a variety of ways. First, increasing the gap 130G' when the segments 140' and 150' begin to separate may produce a larger shockwave or cavitation in the target at the moment of segmentation (e.g., at or soon after the moment the projectile 100' begins to tumble), thus imparting a greater amount of energy to the target. Second, the segments 140' and 150' may separate and independently travel through the target, increasing the chance that some portion of the projectile 100' may strike a vital organ or otherwise inflict lethal damage to the target by creating a plurality of wound channels (e.g., permanent wound channels). Third, like with the projectile 100, the post 130', the surface 118', and the surface 128' may act as cutting surfaces for cleaving through the target when the projectile 100' destabilizes inside the target. However, the broken surfaces of the post 130' may add to the total area which acts as a cutting surface, thus increasing the damage the projectile 100' may impart to the target.

Embodiments of the projectile disclosed herein (e.g., the projectile 100, the projectile 100', the projectile 600) may have a monolithic construction. That is to say, the projectile embodiments disclosed herein may be made of a singular material type and may be devoid of other material types. For instance, embodiments of the projectile 100 and/or the projectile 100' may be made entirely of a metal or metal alloy, such as copper, brass, steel, bronze, et cetera. This is opposed to typical projectile construction, where the projectile itself is made of one material (e.g., lead) and is jacketed or otherwise covered with another material (e.g., steel, copper, et cetera). The conventional projectile is constructed this way in an attempt to confer the external and/or terminal ballistic benefits of each material. However, constructing a projectile of multiple materials is a complex and costly process. By having a monolithic construction, the projectile 100 and/or 100' may be easier/cheaper to manufacture while providing performance that meets or exceeds that of conventional rounds.

In some embodiments, the projectile 100' may be manufactured in such a manner as to further facilitate the segmenting of the projectile 100' along the post 130' into the segments 140' and 150'. For instance, the projectile 100' may have perforations or other weaknesses introduced on or around the post 130' so as to facilitate the breaking thereof during projectile 100' tumbling. As another example, the post 130' may be narrower or thinner where the post 130' meets the surfaces 118' and/or 128', or elsewhere along the length of the post 130', to facilitate breaking therealong. In embodiments, the post 130' may break in situations where the post 130 would not, due to the diameter of the post 130' being narrower than a diameter of the post 130.

The design of the projectile embodiments described herein may be tailored to the specification of the shooter or designer (e.g., tailored for a specific type of shooting application). The specifications that may be changed to affect the performance of the projectile (i.e. larger cavitation) include, for example, a sharper or more acute tapering angle of the tip 115, 115', the radius of the first section 113, 113', the radius of the second section 114, 114', the diameter of the point of the tip 116, 116', the width or diameter of the cylindrical portion 112, 112' and the second cylindrical portion 122, 122', the speed of the projectile 100, 100' when fired from a firearm, the length and/or diameter of the post 130, 130', and the width or diameter of the trailing portion 124, 124'. It was found that, if the more acute (sharper) angle of the tip 115, 115' is located at the forward end of the projectile, the projectile may tumble early upon impact with the target and continue to tumble through the target. If the total length of the first section 113, 113' and the second section 114, 114' is increased, the projectile may tumble. The tumbling of the projectile 100, 100' may also increase in frequency as the total length of the first section 113, 113' and the second section 114, 114' is increased. However, as the total length of the first section 113, 113' and the second section 114, 114' is decreased, the projectile is less likely to tumble, and further shortening the total length of the first section 113, 113' and the second section 114, 114' can prevent the projectile from tumbling at all. It should also be noted that by changing certain aspects of the design, such as length of the tip 115, 115', for example, performance may be affected in ways other than just tumbling. For example, the yaw or roll of the projectile 100, 100' may be affected by such changes. Thus, a projectile manufacturer may use the techniques outlined herein to increase (or decrease) tumbling, or vary other characteristics of a projectile, as compared to another projectile (e.g., a prior art projectile, or relative to a projectile disclosed herein).

FIGS. 5-8 detail various travel paths of projectiles through ballistic gel. When a projectile impacts a target, it releases energy which can be observed as a cavitation in ballistic gel. Larger/more cavitations typically indicate that a greater amount of energy was imparted to the ballistic gel. The cavitations in ballistic gel may also represent damage that would be caused to tissue if the projectile impacted a living target. As the projectile 100 or 100', as shown in FIGS. 6 and 7, respectively, begins to tumble, an increased amount of energy is released. FIG. 5 shows the motion of a projectile, according to prior art designs, fired into ballistic gel from left to right. As the projectile enters the ballistic gel it creates a steady channel 202 prior to destabilizing. The conventional projectile destabilizes after some time and creates the first cavitation 204. The conventional projectile may continue to destabilize, creating a second cavitation 206. After the second cavitation 206, the conventional projectile creates another steady channel 208 until the projectile comes to a stop.

FIG. 6 shows the motion of a projectile according to the embodiment 100 of FIGS. 1 and 2 fired into ballistic gel from left to right. As the projectile 100 enters the ballistic gel, it creates a steady channel 302 prior to tumbling. As the projectile 100 tumbles it creates the first cavitation 304. The projectile 100 then creates a short, steady channel 306 before the projectile 100 tumbles a second time, creating a second cavitation 308. After the second cavitation 308, the projectile 100 creates another steady channel 310 until it stops. Note that, in this example, the projectile 100 has both traveled further and created larger cavitation than the conventional projectile shown in FIG. 5. The artisan would understand that while only two tumbles are depicted here, it is to be understood that the projectile 100 may tumble more than two times.

FIG. 7 shows the motion of a projectile according to the embodiment 100' of FIGS. 3 and 4 fired into ballistic gel from left to right. This projectile 100' motion can be broken up into several portions: the primary projectile 100' travel path 418, and a plurality of auxiliary projectile 100' travel paths 420 and 422. As the projectile 100' enters the ballistic gel, it creates a steady channel 402 prior to tumbling. As the projectile 100' tumbles it creates the first cavitation 404. Here, the projectile 100' motion deviates from the projectile 100 motion. As the projectile 100' first tumbles, the projectile 100' may break or segment along the center post 130' into the plurality of segments 140' and 150'. These segments 140' and 150' may continue onwards to create short, steady channels 406 and 408, respectively, before each segment 140' and 150' tumbles a second time. The secondary tumbling of the segments 140' and 150' may create cavitations 410 and 412, respectively, until coming to a stop in short channels 414 and 416, respectively. In summary, the projectile 100' may travel along the primary travel path 418 as a single piece until the projectile 100' segments. At this point, one of the segments 140' or 150' may travel along the first auxiliary travel path 420 while the other travels along the second auxiliary travel path 422. Put another way, the projectile 100' may create a plurality of wound channels (e.g., temporary wound channels and/or permanent wound channels) as the projectile 100' passes through a target. Note that segments 140', 150' having about the same size may typically result in similar auxiliary travel paths 420, 422. The artisan would understand that while the segment is shown here to only tumble three times, it is to be understood that the projectile 100' may tumble more than three times.

As can be readily observed, the projectile 100' may create both larger and longer channels in the ballistic gel relative to the conventional projectile travel path shown in FIG. 5, especially taking into consideration the combination of the travel paths 418, 420, and 422.

Figure 8:
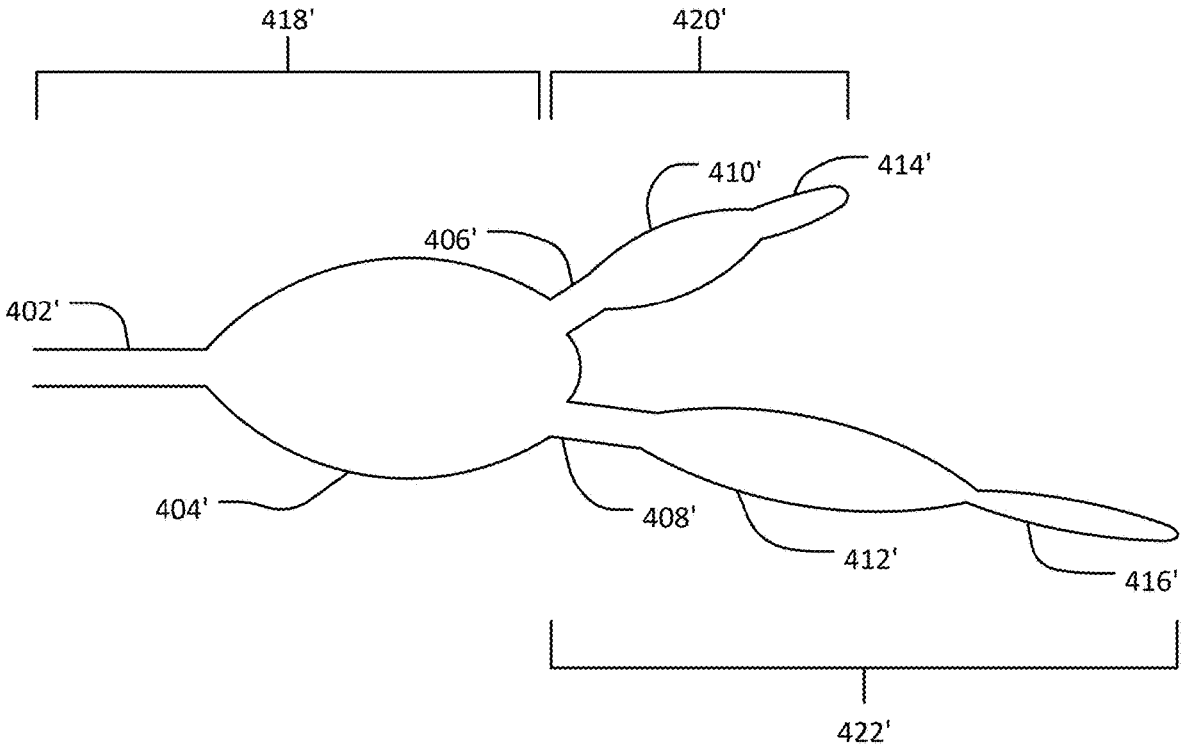
FIG. 8 is a schematic showing the motion of the projectile of FIG. 3 in an alternate embodiment, fired into ballistic gel.

FIG. 8 shows the motion of a projectile according to the embodiment 100' fired into ballistic gel from left to right, however the segments 140' and 150' are of disparate sizes. The motion of such a projectile 100' may be similar to the motion described in FIG. 7, except where explicitly stated or otherwise implied. This projectile 100' motion can be broken up into a primary travel path 418', and a plurality of auxiliary travel paths 420' and 422'. As the projectile 100' enters the ballistic gel, it creates a steady channel 402' prior to tumbling. As the projectile 100' first beings to tumble, it creates the first cavitation 404'. The projectile 100' may then break or segment along the center post 130' into the plurality of segments 140' and 150'. These segments 140' and 150' may continue onwards to create short, steady channels 406' and 408' before each segment 140' and 150' tumbles a second time. The secondary tumbling of the segments 140' and 150' may create cavitations 410' and 412' until coming to a stop in short channels 414' and 416'.

In summary, the motion described in FIG. 8 may be like the motion described in FIG. 7, with one key difference. Here, the travel path 422' may be greater (e.g., greater in size, depth, length, etc.) than the travel path 420'. The wound channels that would result from these travel paths 420' and 422' would reflect a similar difference. This may be because the segment 140' or 150' which is of a smaller size may create the travel path 420' and the other of the segment 140' or 150' having the larger size may create the travel path 422'. Put another way, the segment 140' or 150' having the greater mass may penetrate deeper and/or impart more energy than the other. This may result in segment 140', 150' penetrations that are different from those shown in FIG. 7. For instance, the first auxiliary travel path 420' may overall be shorter than the first auxiliary length 420, indicating less penetration through the medium. This situation may stem from the segment which created the auxiliary travel path 420' being smaller (e.g., having less mass) than the segment which created the auxiliary travel path 420. Further, the second travel path 422' may overall be longer than the second auxiliary length 422, indicating more penetration through the medium. This situation may stem from the segment which created the auxiliary travel path 422' being larger (e.g., having more mass) than the segment which created the auxiliary travel path 420. The artisan would understand that while only three tumbles are depicted here for each segment, it is to be understood that the projectile 100' may tumble more than three times.

The channels shown in FIGS. 5-8 demonstrate the benefits of the various embodiments of the disclosure. Compared to the conventional projectile in FIG. 5, the embodiments 100 and 100', whose cavitation patterns are shown in FIGS. 6 and 7, respectively, transfer an increased amount of energy to the target and may do so in a more efficient manner. Looking at FIGS. 6 and 7, the embodiments 100 and 100' create, in total, longer channels in the target than the prior art design projectile of FIG. 5. As well, the cavitations in FIGS. 6 and 7 are larger than those in FIG. 5, which signifies an increased amount of damage caused to the target.

Figure 9:
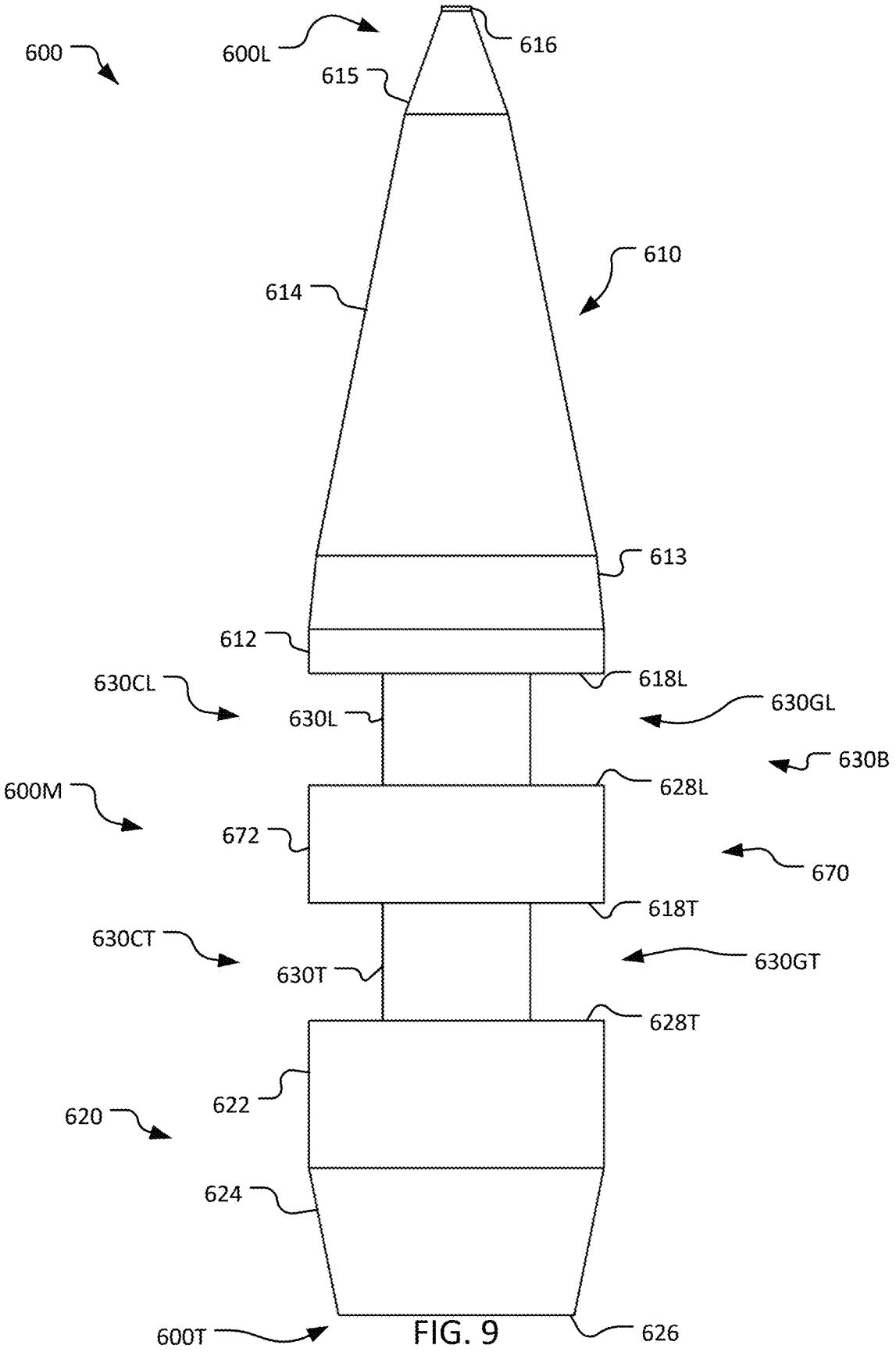
FIG. 9 is a side view of a projectile used in the firearm, according to another embodiment of the disclosure, before segmenting.
Figure 10:
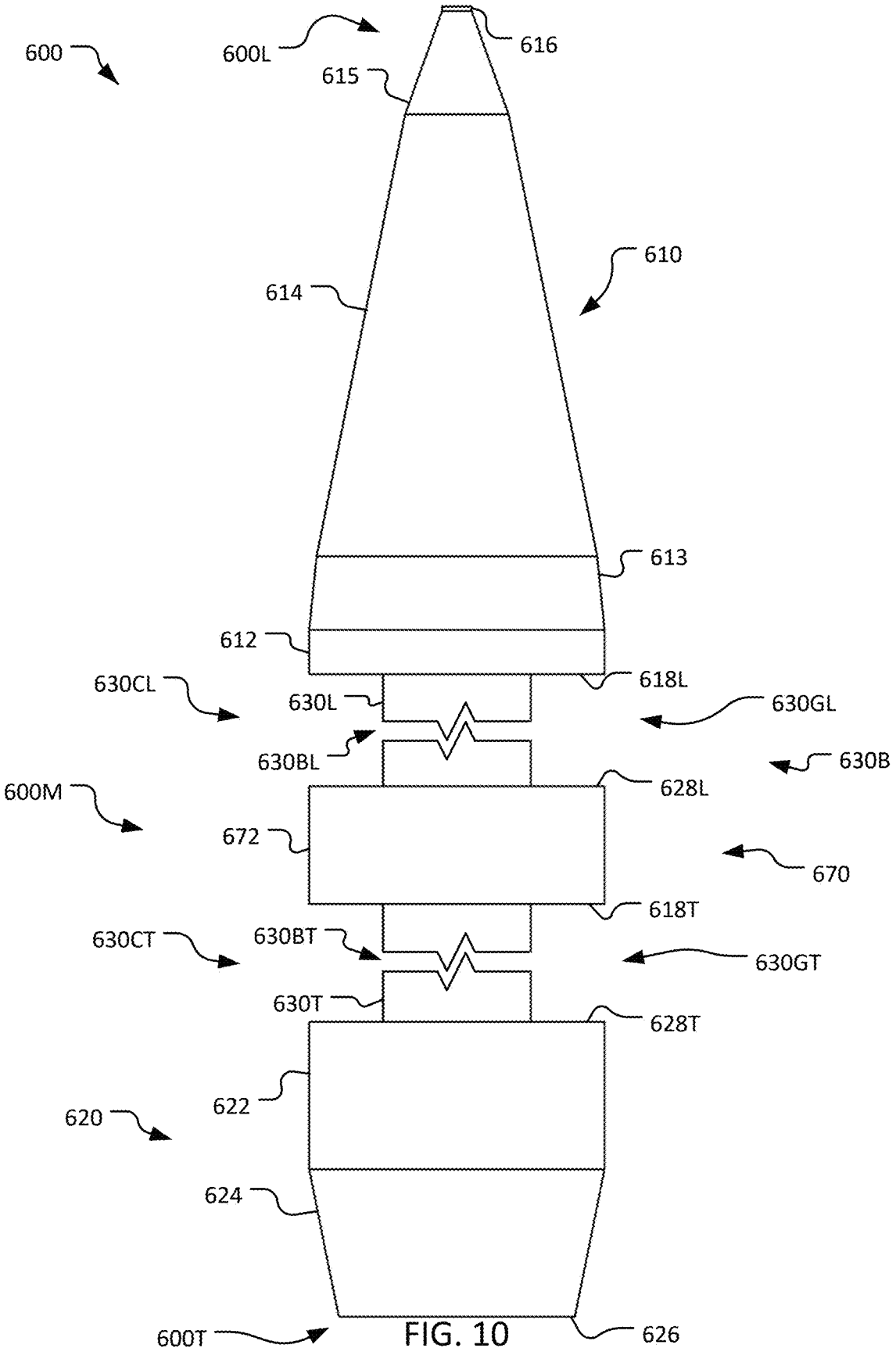
FIG. 10 is a side view of the projectile of FIG. 9, after segmenting.

FIGS. 9 and 10 show yet another embodiment 600 of the tumbling projectile that may be substantially the same or similar to the embodiment 100', except where expressly noted or would be inherent. The structure of the projectile 600 may be substantially the same as the projectile 100', except that the projectile 600 may be designed to instead break into three segments (e.g., first segment 640, second segment 650, and third segment 660) along a leading collar 630CL (e.g., the leading center post 630L thereof) and a trailing collar 630CT (e.g., the trailing center post 630T thereof) after the projectile 600 penetrates a target and begins to tumble. The posts 630L and 630T may desirably break when the posts 630L, 630T are acted upon by the non-air medium which the projectile 600 is traveling through after the projectile 600 begins to tumble, keyhole, or otherwise turn sideways inside the target.

FIG. 10 shows where an example leading break 630BL and an example trailing break 630BT may occur (i.e., around opposing sides of a third cylindrical section 672 of a center portion 670). The first segment 640 may largely comprise the top portion 610 and whatever portion of the leading post 630L remains attached to the top portion 610 after the break. The second segment 650 may largely comprise the bottom portion 620 and whatever portion of the trailing post 630T that remains attached to the bottom portion 620 after the break. The third segment 660 may largely comprise the middle portion 670 and whatever portions of the leading post 630L and/or the trailing post 630T that remain attached to the middle portion 670 after the break. Put another way, the first segment 640 may generally comprise the portion of the projectile 600 originally above the leading collar 630CL, the second segment 650 may generally comprise the portion of the projectile 600 originally below the trailing collar 630CT, and the third segment 660 may generally comprise the portion of the projectile 600 originally between the leading collar 630CL and the trailing collar 630CT. While some embodiments of the projectile 600 may have segments 640, 650, and/or 660 of approximately the same size, this may not be the case in others.

Figure 11:
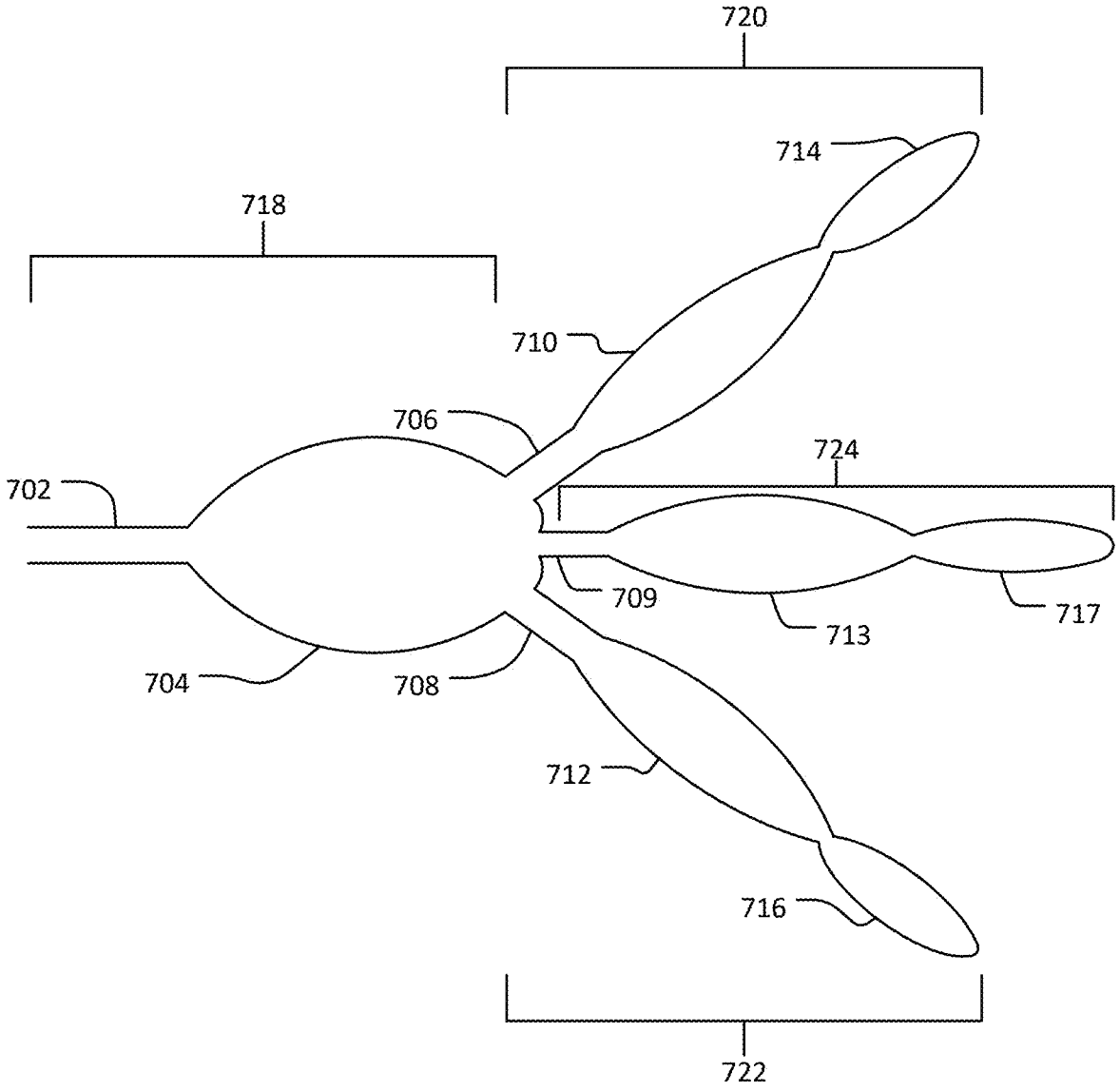
FIG. 11 is a schematic showing the motion of the projectile of FIG. 9, fired into ballistic gel.

FIG. 11 shows the motion of a projectile according to the embodiment 600 of FIGS. 9 and 10 fired into ballistic gel from left to right. This projectile 600 motion can be broken up into several portions: the primary projectile 600 travel path 718, and a plurality of auxiliary projectile 600 travel paths 720, 722, and 724. As the projectile 600 enters the ballistic gel, it creates a steady channel 702 prior to tumbling. As the projectile 600 tumbles it creates the first cavitation 704. Here, the projectile 600 motion deviates from the projectile 100' motion. As the projectile 600 first tumbles, the projectile 600 may break or segment along the posts 630L, 630L into the plurality of segments 640, 650, and 660. These segments 640, 650, 660 may continue onwards to create short, steady channels 706, 708, 709, respectively, before each segment 640, 650, and 660 tumbles a second time. The secondary tumbling of the segments 640, 650, and 660 may create cavitations 710, 712, and 712, respectively, until coming to a stop in short channels 714, 716, and 717, respectively. In summary, the projectile 600 may travel along the primary travel path 718 as a single piece until the projectile 600 segments. At this point, one of the segments 640, 650, or 660 may travel along the first auxiliary travel path 720, while another travels along the second auxiliary travel path 722, and the last of the segments 640, 650, 660 travels along the third auxiliary travel path 724. Put another way, the projectile 600 may create a plurality of wound channels (e.g., temporary wound channels and/or permanent wound channels) as the projectile 600 passes through a target. Note that segments 640, 650, 660 having about the same size may typically result in similar auxiliary travel paths 720, 722, 724. The artisan would understand that while the segments shown here only tumble three times, it is to be understood that the segments may tumble more than three times.

As can be readily observed, the projectile 600 may create both larger and longer channels in the ballistic gel relative to the conventional projectile travel path shown in FIG. 5, especially taking into consideration the combination of the travel paths 718, 720, 722, and 724.

Figure 12:
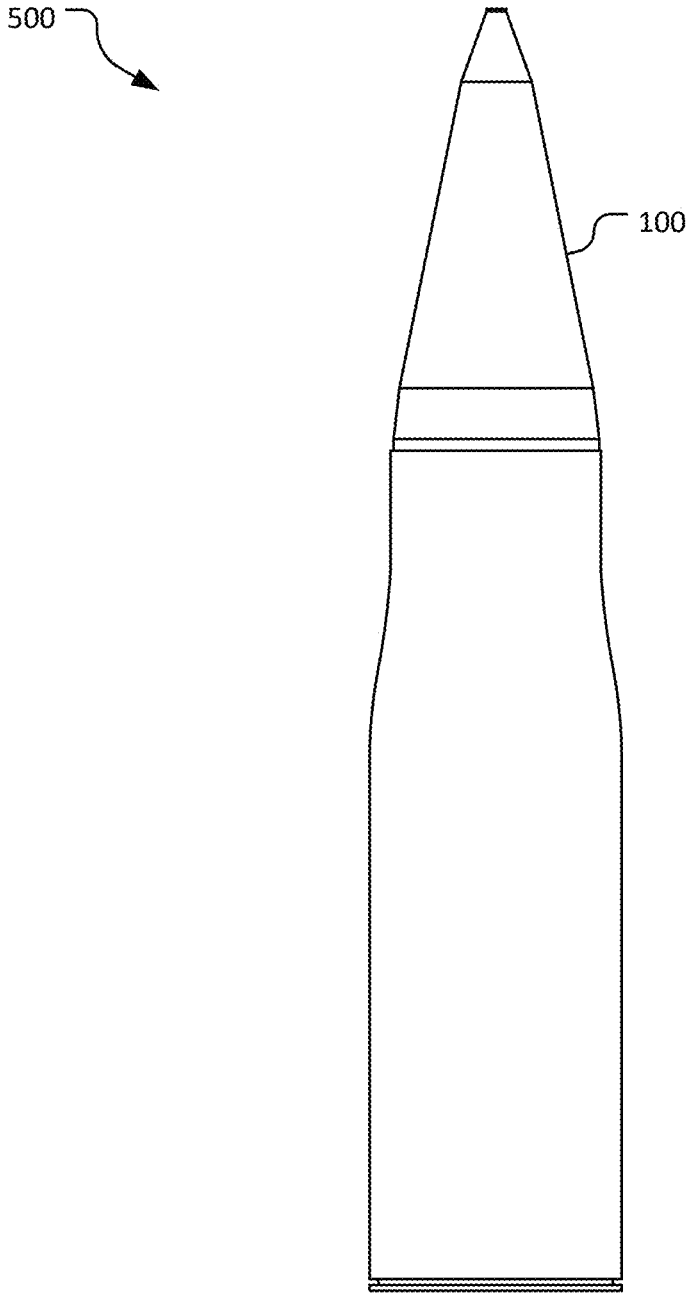
FIG. 12 is a side view of a cartridge having the projectile of FIG. 1, according to an embodiment of the disclosure.
Figure 13:
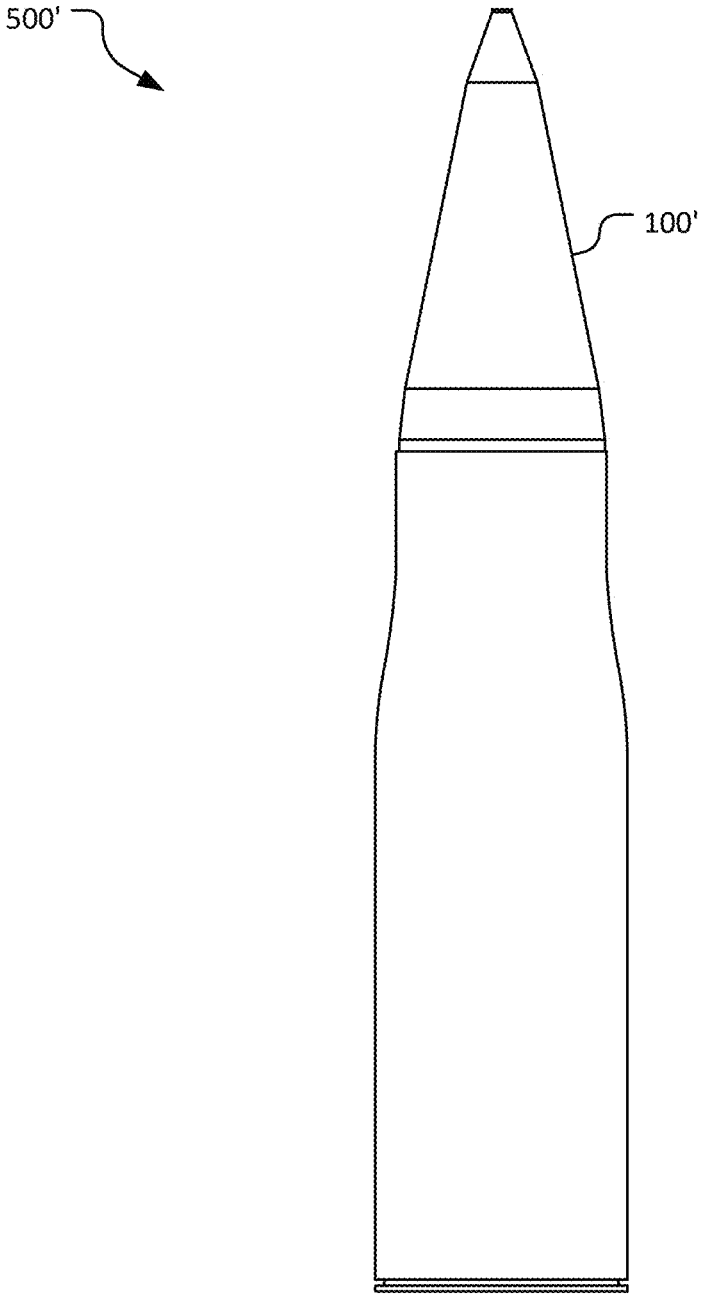
FIG. 13 is a side view of a cartridge having the projectile of FIG. 3, according to another embodiment of the disclosure.
Figure 14:
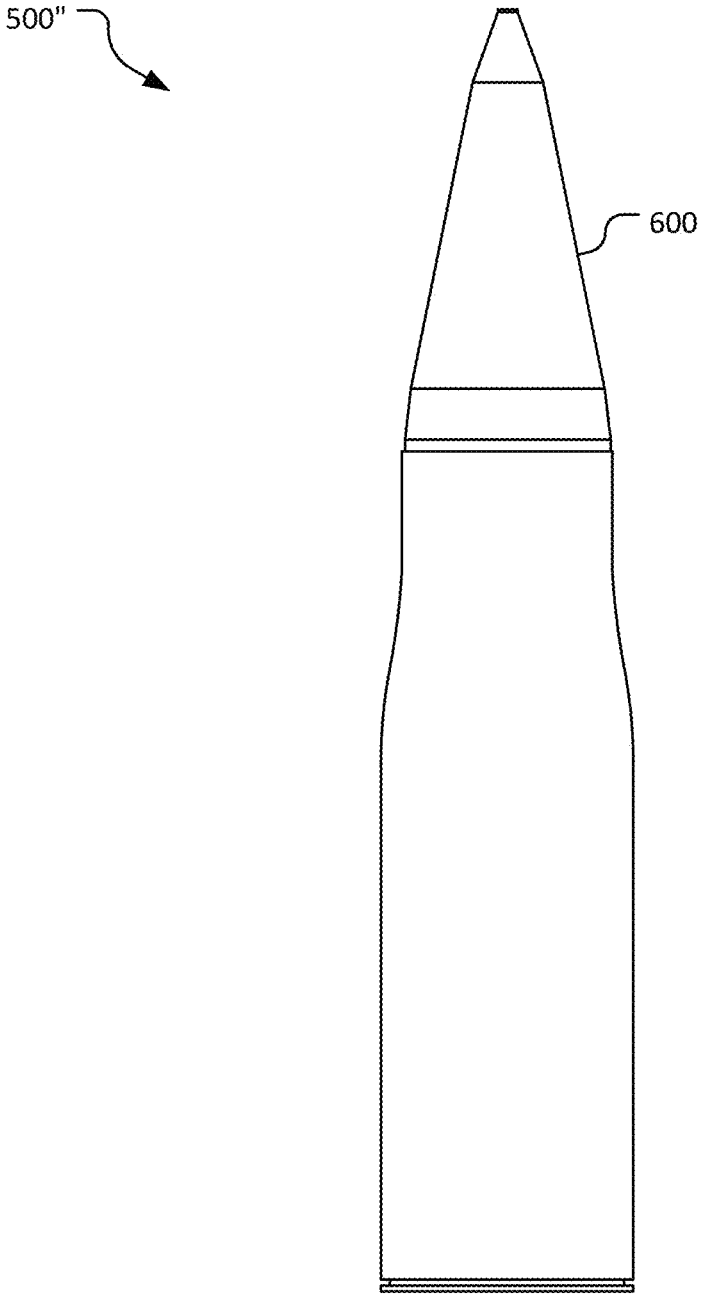
FIG. 14 is a side view of a cartridge having the projectile of FIG. 9, according to another embodiment of the disclosure.

While the projectile 100 has largely been described above independent of any other system, in embodiments, the projectile 100 may be incorporated within a cartridge 500, as shown in FIG. 12. Likewise, the projectile 100' may be incorporated with a cartridge 500' as shown in FIG. 13, and the projectile 600 may be incorporated with a cartridge 500", as shown in FIG. 14. The cartridge 500, 500', 500" type may be any suitable cartridge type now known or subsequently developed, such as a pistol cartridge, a rifle cartridge, an intermediate cartridge, et cetera. Similarly, the cartridge 500, 500', 500" may have any suitable cartridge component now known or subsequently developed, such as a centerfire primer, a rimfire primer, gunpowder, a casing, et cetera. While the posts 130, 130', 630L, and 630T may not be exposed from the casings in FIGS. 12, 13, and 14 (e.g., to preclude hot gas from prematurely compromising the projectile 100, 100', or 600), embodiments of the cartridges 500, 500', 500" may be configured such that the posts 130, 130', 630L, or 630T are exposed for viewing out from the casing of the cartridge 500, 500', 500".

Thus, as has been described, the projectiles concepts disclosed herein, such as the embodiments 100, 100', and 600 may impart a greater portion of their kinetic energy to a target when compared to conventional projectiles. The projectile concepts disclosed herein have been found to tumble more dramatically when they impact a viscous or semi-fluid object, such as animal organs or flesh, than if they impact something more solid such as wood or metal. Moreover, the embodiment 100 is relatively more lethal and thus more humane compared to standard projectiles when used to hunt. These features are more prominent with projectile embodiments such as 100, 100', and 600 than with others known to be available, including those that fragment or tumble. The projectile 100' segments only along the middle portion 100M' of the projectile 100' (rather than from the leading end). Similarly, the projectile 600 segments only along the collars 630L and 630T. In this way, the projectiles 100' and 600 may maintain the external ballistic advantages conferred by a spitzer style projectile, or other type of projectile, while gaining the advantages (e.g., the terminal ballistic advantages) of a projectile which breaks into a plurality of pieces.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations.

The invention claimed is:

1. A projectile, comprising:

a first portion having a first cylindrical portion having a first flat end surface, a section extending from said first cylindrical portion at a first acute angle, and a tip section extending from said section and terminating in a tip;

a second portion having a second cylindrical portion having a second flat end surface;

a trailing portion having a generally frustoconical shape, said trailing portion tapering towards a trailing end of said projectile; and a post coupling said first cylindrical portion and said second cylindrical portion, said post being in contact with each of said first flat end surface and said second flat end surface, said post being cylindrical and having a post diameter that is less than each of a diameter of said first cylindrical portion and a diameter of said second cylindrical portion;

wherein:

said projectile is configured to tumble upon impact with a target; and said post is configured to break upon impact with said target.

2. The projectile of claim 1, wherein said first cylindrical portion comprises a groove.

3. The projectile of claim 2, wherein said second cylindrical portion comprises a groove.

4. The projectile of claim 1, wherein a length of said section is proportional to a tumbling characteristic of said projectile, such that increasing said length of said section increases the tumbling characteristic of said projectile.

5. The projectile of claim 1, wherein said projectile is configured to create a plurality of channels in said target after impact with said target.

6. The projectile of claim 1, further comprising a cartridge.

7. The projectile of claim 1, wherein said tip section extends from said section at a second acute angle.

8. The projectile of claim 7, wherein said second acute angle is sharper than said first acute angle.

9. A projectile, comprising:

a first portion having a first flat end surface;

a second portion having a second flat end surface; and a post coupling said first portion and said second portion at said first flat end surface and said second flat end surface such that at least a portion of each of said first flat end surface and said second flat end surface is exposed;

wherein:

said projectile is configured to tumble upon impact with a target; and said post is configured to break upon impact with said target.

10. The projectile of claim 9, wherein:

said first portion includes a first section adjacent said post, said first section tapering at a first angle; and a second section adjacent said first section, said second section tapering at a second angle.

11. The projectile of claim 10, further comprising a tip section with a tip having a diameter, wherein said diameter is inversely proportional to a tumbling characteristic of said projectile, such that decreasing said diameter of said tip increase said tumbling characteristic of said projectile.

12. The projectile of claim 11, further comprising a frustoconical trailing section having a trailing section flat end surface.

13. The projectile of claim 12, wherein said projectile terminates at said trailing section flat end surface.

14. The projectile of claim 9, wherein said post is cylindrical.

15. The projectile of claim 9, wherein said second portion comprises at least one groove.

16. The projectile of claim 15, wherein said first portion comprises at least one groove.

17. A projectile, comprising:

a first portion having a first cylindrical portion having a first flat end surface, a section extending from said first cylindrical portion, and a tip section extending from said section and terminating in a tip;

a second portion having a second cylindrical portion having a second flat end surface; and a post coupling said first cylindrical portion and said second cylindrical portion, said post being in contact with each of said first flat end surface and said second flat end surface, said post being cylindrical and having a post diameter that is less than each of a diameter of said first cylindrical portion and a diameter of said second cylindrical portion;

wherein:

said projectile is configured to tumble upon impact with a target; and said post is configured to break upon impact with said target.

18. The projectile of claim 17, wherein said projectile is configured to create a plurality of channels in said target after impact with said target.

19. The projectile of claim 17, further comprising at least one groove in each of said first portion and said second portion.

20. The projectile of claim 17, wherein said projectile terminates in a trailing section having a flat end.

* * * * *